US007229691B2

(12) United States Patent
Noda

(10) Patent No.: US 7,229,691 B2
(45) Date of Patent: Jun. 12, 2007

(54) COMPOSITE CONSTRUCTION

(75) Inventor: Kenji Noda, Sendai (JP)

(73) Assignee: Kyocera Corporation, Kyoto (JP)

( * ) Notice: Subject to any disclaimer, the term of this patent is extended or adjusted under 35 U.S.C. 154(b) by 396 days.

(21) Appl. No.: 10/781,298

(22) Filed: Feb. 18, 2004

(65) Prior Publication Data

US 2004/0234765 A1 Nov. 25, 2004

(30) Foreign Application Priority Data

Feb. 18, 2003 (JP) ..... 2003-040325

(51) Int. Cl.
*B22F 3/00* (2006.01)
*B32B 9/00* (2006.01)

(52) U.S. Cl. ..... 428/408; 428/698

(58) Field of Classification Search ..... 428/408, 428/701, 698; 501/97
See application file for complete search history.

(56) References Cited

U.S. PATENT DOCUMENTS 6,063,502 A * 5/2000 Sue et al. ..... 428/469
6,273,924 B1 8/2001 Krenkel et al. ..... 051/307
6,361,873 B1 * 3/2002 Yong et al. ..... 428/469
6,709,737 B2 * 3/2004 Rigali et al. ..... 428/304.4

FOREIGN PATENT DOCUMENTS

JP 11-139884 5/1999
JP 2001-509093 7/2001

* cited by examiner

*Primary Examiner*—Jennifer McNeil
*Assistant Examiner*—Daniel Miller
(74) *Attorney, Agent, or Firm*—Hogan & Hartson LLP

(57) ABSTRACT

The composite structure of the present invention comprises an elongate core material of a sintered diamond material comprising 80% by volume or more diamond particles of a mean particle size not larger than 3.5 μm that are bound by an iron group metal; and a shell layer of a sintered alloy comprising at least one kind of hard particles selected from among carbide, nitride and carbonitride of at least one metal element selected from the group of 4a, 5a and 6a group metals of the Periodic Table and diamond particles having a mean particle size not larger than 5 μm that are bound by an iron group metal, wherein content of the diamond particles in the shell layer is from 5 to 45% by volume, thereby improving wear resistance, adhesion resistance and chipping resistance of cutting tool, while maintaining high hardness and high strength.

9 Claims, 11 Drawing Sheets

(b)

COMPOSITE CONSTRUCTION

Priority is claimed to Japanese Patent Application No. 2003-40325, filed on Feb. 18, 2003, the disclosure of which is incorporated by reference in its entirety.

BACKGROUND OF THE INVENTION

1. Field of the Invention

The present invention relates to a composite structure that the circumference of a core material made of a sintered diamond is coated with a shell layer made of a sintered alloy.

2. Description of Related Art

Such a technology has been researched that improves hardness, strength and toughness of a structure by coating an elongate core material such as filament with other material. Japanese Unexamined Patent Publication (Kokai) No. 11-139884, for example, discloses a sintered composite ceramic made by coating the circumference of a core material made of ceramic (filament-like ceramic) with a coating layer of a second component by spraying, bundling the coated core materials, subjecting the assembly to compression molding and sintering it, in order to increase the fracture resistance of the structure.

On the other hand, sintered diamond material comprising diamond particles bound by an iron-group metal has been used in cutting tools, mining tools and abrasion resistant parts, taking advantage of the high hardness of diamond. U.S. Pat. No. 6,063,502 discloses a composite structure comprising a core material made of a sintered diamond with a shell layer made of WC—Co being provided on the circumference thereof.

However, the sintered diamond material of the prior art described above has high hardness but low toughness and low impact resistance, and is poor in chipping resisting performance for the applications as cutting tools or mining tools.

In the case of a composite structure comprising a core material made of a sintered diamond coated with a shell layer made of a sintered alloy such as cemented carbide (WC) constituted mainly from metal of the group 4a, 5a or 6a of the Periodic Table such as that described in the U.S. Pat. No. 6,063,502, particularly when the mean particle size of diamond particles in the core material is made small in order to increase the strength, balance between the infiltration of the binding metal and the wettability of the diamond particles is lost, resulting in a region deficient of the binding metal being formed in a considerable area in the core material in the interface with the shell layer. Presence of such a region where the binding metal is distributed unevenly results in a lower strength of the structure. A cutting tool made of such a material has low wear resistance and low adhesion resistance. Moreover, chipping resistance may significantly decrease when the direction of filament orientation in the structure deviates even slightly from the direction of the cutting edge resulting in significant decrease in the binding force between the filaments.

SUMMARY OF THE INVENTION

An advantage of the present invention is to provide a composite structure that can stably maintain high hardness and high strength, and when using as a cutting tool, has high wear resistance, high adhesion resistance and high chipping resistance.

The present invention provides a composite structure comprising a core material made of a sintered material that includes 80% by volume or more diamond particles and a shell layer made of a sintered alloy that is constituted mainly from cemented carbide or cermet. 5 to 45% by volume of diamond particles is included in the sintered alloy of the shell layer so as to suppress the problem that a region deficient of the iron group metal is formed in a considerable area in the core material (sintered diamond) in the interface with the shell layer, thereby achieving a uniform concentration of iron group metal that serves as the binding metal. Thus it makes possible to stably improve the strength of the structure. As a result, wear resistance and adhesion resistance of a tool can be improved, and excessive variability of chipping resistance due to the deviation of the direction of filament orientation in the cutting tool can be lowered.

The composite structure according to the present invention comprises an elongate core material of a sintered diamond comprising 80% by volume or more diamond particles of a mean particle size not larger than 3.5 μm, and an iron group metal binding the diamond particles; and a shell layer that covers the circumference of said core material and comprises a sintered alloy of at least one kind of hard particles selected from among carbide, nitride and carbonitride of at least one metal element selected from the group of 4a, 5a and 6a group metals of the Periodic Table and diamond particles of a mean particle size not larger than 5 μm, and an iron group metal binding the hard particles and diamond particles, wherein content of said diamond particles included in said shell layer is from 5 to 45% by volume.

DESCRIPTION OF PREFERRED EMBODIMENTS

The composite structure of the present invention will be described with reference to the schematic sectional view of FIG. 1 that shows one embodiment thereof and FIG. 2 that is an enlarged view of a key portion of the former.

Figure 1:
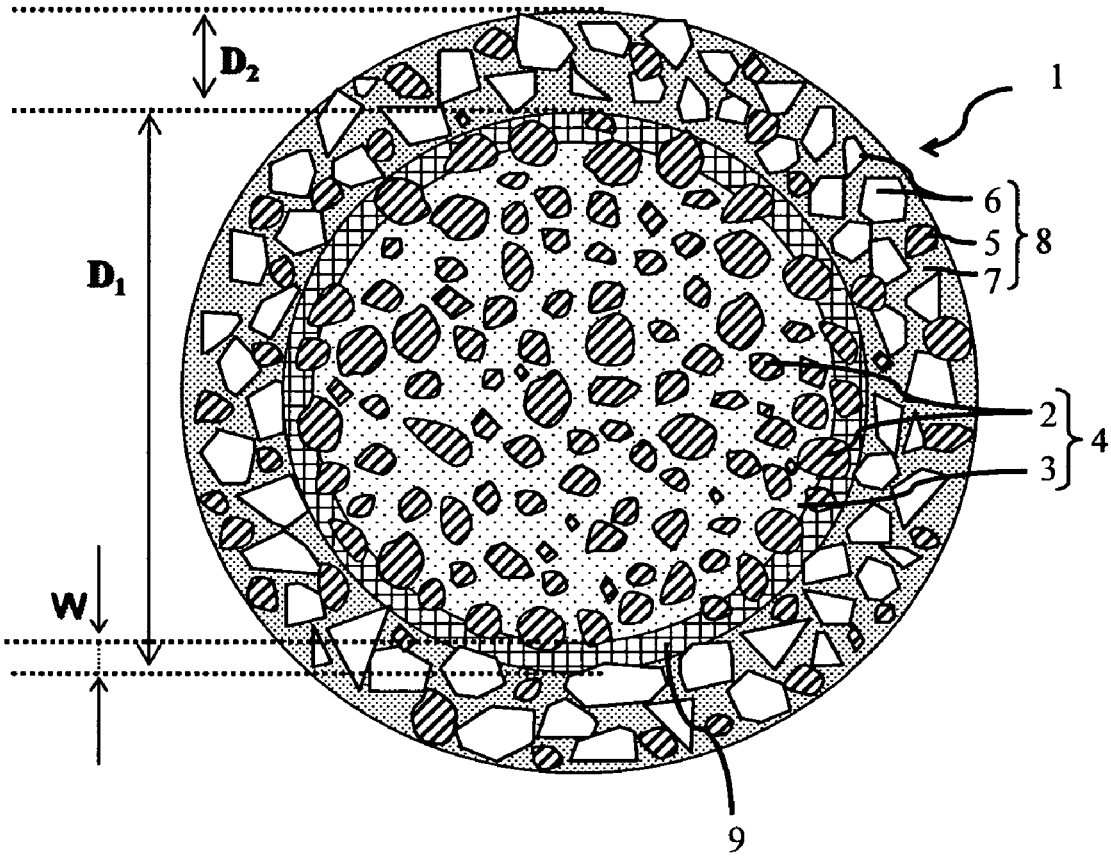
FIG. 1 is a schematic sectional view showing an embodiment of the composite structure according to the present invention.

As shown in FIG. 1, the composite structure 1 comprises an elongate core material 4, and a shell layer 8 coating the circumference of the core material 4. The core material 4 is made of a sintered diamond that is constituted from 80% by volume or more diamond particles 2 of a mean particle size not larger than 3.5 μm that are bound by an iron group metal 3. The shell layer 8 is made of a sintered alloy constituted from at least one kind of hard particles 6 selected from among carbide, nitride and carbonitride of at least one metal element selected from the group of 4a, 5a and 6a group metals of the Periodic Table and diamond particles 5 of a mean particle size not larger than 5 μm that are bound by an iron group metal 7. The content of the diamond particles 5 in the shell layer 8 is from 5 to 45% by volume.

The hard particles 6 may be made of, for example, tungsten carbide, titanium carbide, titanium carbonitride, titanium nitride, tantalum carbide, niobium carbide, zirconium carbide, zirconium nitride, vanadium carbide, chromium carbide or molybdenum carbide, and particularly tungsten carbide (WC) particles are preferably used for the reason of affinity and wettability with the diamond particles 2, 5, and improvement of toughness of the structure 1. For the iron group metal 7, for example, Fe, Co or Ni may be used.

Figure 2:
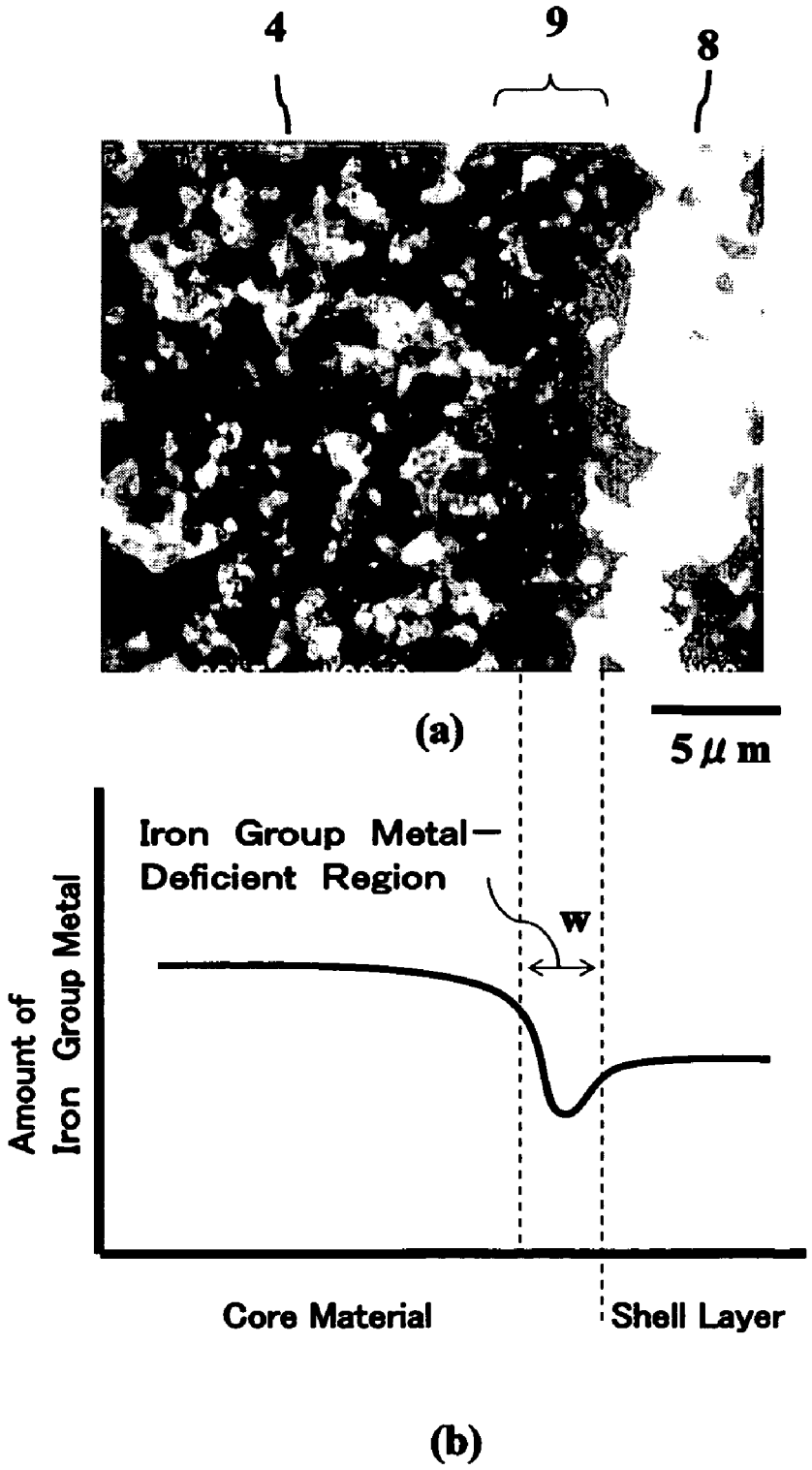
FIG. 2 is a scanning electron microphotograph of a section of the composite structure of FIG. 1 in the vicinity of interface between the core material and the shell layer, and a graph showing the concentration of iron group metal in the region shown in the scanning electron microphotograph.

According to the present invention, as shown in FIG. 2, uneven distribution in the concentration of the iron group metal in the region ranging from the center of the core material 4 made of the sintered diamond to the interface with the shell layer 8 can be lowered, as compared with the composite structure shown in FIG. 7, which will be described later. Thus, the strength of the structure 1 is improved, and when using as a cutting tool, wear resistance and adhesion resistance with workpiece are improved, and significant variability in the chipping resistance, that is caused when the direction of filament orientation in the cutting tool deviates slightly from the direction of the cutting edge, can be lowered.

Figure 7:
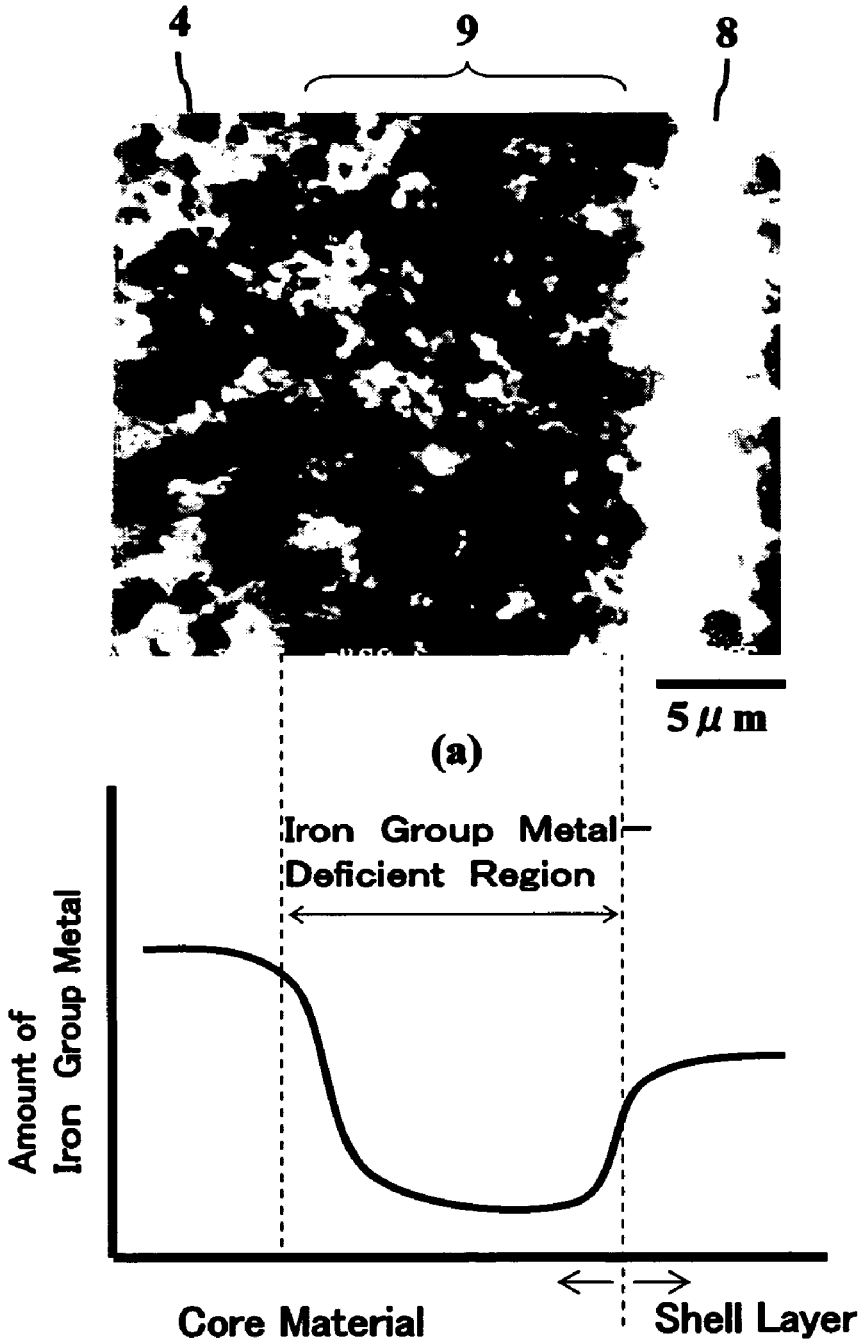
FIG. 7(*a*) is a scanning electron microphotograph of a section of a composite structure which does not include diamond particles in the sintered alloy of the shell layer in the vicinity of the interface between the core material and the shell layer, and FIG. 7(*b*) is a graph showing the concentration of iron group metal in the region shown in the electron microphotograph.

When content of the diamond particles in the shell layer 8 is less than 5% by volume, significant unevenness is caused in the distribution of the iron group metal in the core material 4, resulting in iron group metal-deficient region 9 where concentration of the binding metal is insufficient around the interface between the core material 4 and the shell layer 8 being generated to a considerable extent, as shown in FIG. 7. This results in lower strength of the structure, and especially, as a cutting tool, low wear resistance and low adhesion resistance are damaged, while chipping resistance significantly decreases when the direction of filament orientation in the structure deviates even slightly from the direction of the cutting edge. When the content of diamond particles in the shell layer 8 is more than 45% by volume, on the other hand, the effect of improving the toughness of the composite structure 1 is damaged, and resulting in lower toughness. According to the present invention, concentration of iron group metal in the iron group metal-deficient region 9 is preferably not less than 0.5 times, particularly not less than 0.7 times the concentration of iron group metal in the central region of the core material 4, in order to achieve uniform characteristics of the structure and increase the strength.

Contents of other components in the shell layer 8 are preferably from 55 to 95% by volume for the hard particles 6 and 5 to 50% by volume for the iron group metal 7.

The mean particle size of the diamond particles 2 in the core material 4 is 3.5 μm or smaller, and preferably in a range from 0.01 to 2.5 μm. When the mean particle size of the diamond particles 2 included in the core material 4 is larger than 3.5 μm, the strength of the structure 1 may decrease.

Content of the diamond particles 2 in the core material 4 is not less than 80% by volume, and preferably in a range from 80 to 97% by volume. When content of the diamond particles 2 in the core material 4 is less than 80% by volume, hardness of the structure 1 may become lower. Desirable content of the diamond particles 2 in the core material 4 is 90% by volume or higher. Remaining component of the core material 4 is the iron group metal used as the binder.

Contents (volumetric proportion) of the diamond particles 2, 5 are calculated on the recognition that the proportion is equal to the area of the component in a sectional area of the core material 4 (sintered diamond) (Mechanical Properties of Ceramics edited by Lecture working group of Ceramics Editing Committee, published by Ceramic Industry Association on May 1, 1979; pp29-30). Specifically, the content can be estimated by calculating the proportion of the area occupied by the diamond particles 2, 5 in a scanning electron microphotograph of a section of the structure 1.

The mean particle size of the diamond particles 5 included in the shell layer 8 is 5.0 μm or smaller, and preferably in a range from 0.1 to 2.5 μm. When the mean particle size deviates from this range, content of the iron group metal included in the core member 4 may become imbalance.

As a result of controlling the composition and constitution of the core member 4 and the shell layer 8 in the above-mentioned content ratio, ratio ($w/D_1$) of width "w" of the iron group metal-deficient region (a region where concentration of iron group metal is low) in the interface between the core material 4 and the shell layer 8 to the mean diameter "$D_1$" of the core material 4 becomes 0.2 or less and preferably 0.1 or less. Thus, the strength of the structure is increased, and the wear resistance and adhesion resistance of the tool are improved while suppressing excessive variation in the chipping resistance.

The width "w" of the iron group metal-deficient region 9 in the core material 4 around the interface with the shell layer 8 is the width of a region where the concentration of iron group metal is lower than the average concentration of iron group metal at the center of the core material 4 by 20% or more, when the concentration of iron group metal is determined by wavelength dispersive type X-ray spectroscopy microanalysis (EPMA) of a section of the structure 1 in the interface between the core material 4 and the shell layer 8 as shown in FIG. 2. The mean diameter $D_1$ of the core material 4 refers to the diameter of a circle calculated from the cross sectional area of the core material member shown in a scanning electron microphotograph (SEM) (refer to, for example, FIG. 3(*b*)) of the cross section of the structure 1. Mean thickness $D_2$ of the shell layer 8 may also be calculated by image analysis using SEM microphotograph (refer to, for example, FIG. 3(*b*)).

A ratio $d_{S1}/d_{S2}$ of the mean particle size $d_{S1}$ of the diamond particles 5 included in the shell layer 8 to the mean particle size $d_{S2}$ of the hard particles 6 included in the shell layer 8 is preferably in a range from 0.4 to 3.0 in order to control the concentration distribution due to infiltration of the binding metal and achieve uniform distribution of the iron group metal.

Mean diameter $D_1$ of the core material 4 is preferably 500 μm or smaller, more preferably in a range from 2 to 200 μm, and mean thickness $D_2$ of the shell layer 8 is preferably 500 μm or smaller, more preferably in a range from 2 to 200 μm, when the application for structural member is taken into consideration. In order to achieve higher hardness, ratio $D_2/D_1$ of the mean thickness $D_2$ of the shell layer 8 to the mean diameter $D_1$ of the core material 4 is preferably in a range from 0.01 to 0.5.

Figure 3:
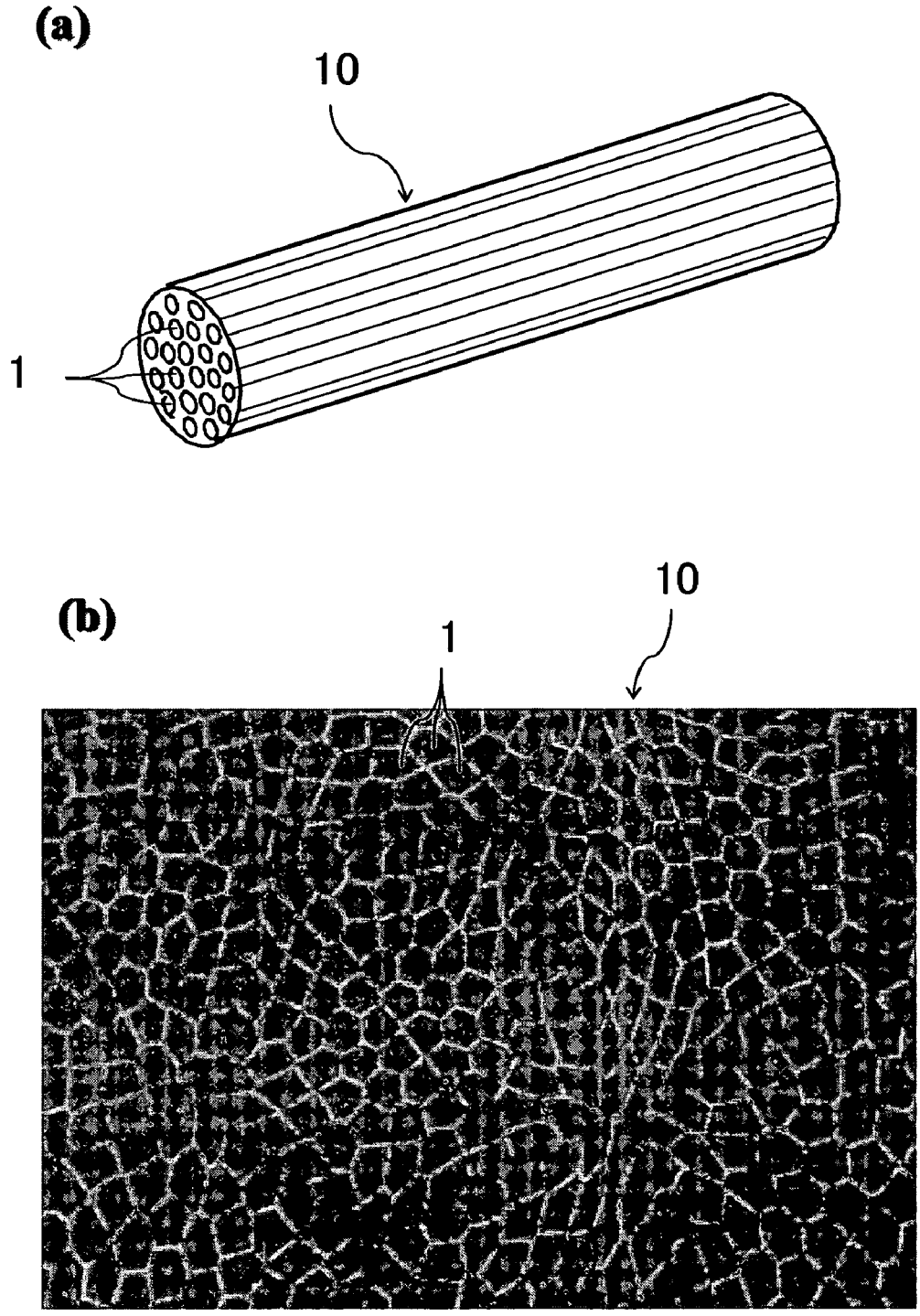
FIG. 3(*a*) is a perspective view showing another example of the present invention, and FIG. 3(*b*) is a scanning electron microphotograph of a section thereof.

FIG. 3(*a*), (*b*) show another example of the composite structure used in the present invention. The composite structure 10 shown in FIG. 3(*a*) is a multiple filament type composite structure made by bundling a plurality of single filament type composite structure 1 each of which is constituted from the core material 4 and a shell layer 8 that is made of a material having different composition from that of the core material 4 and covers the circumference of the core material 4.

Figure 4:
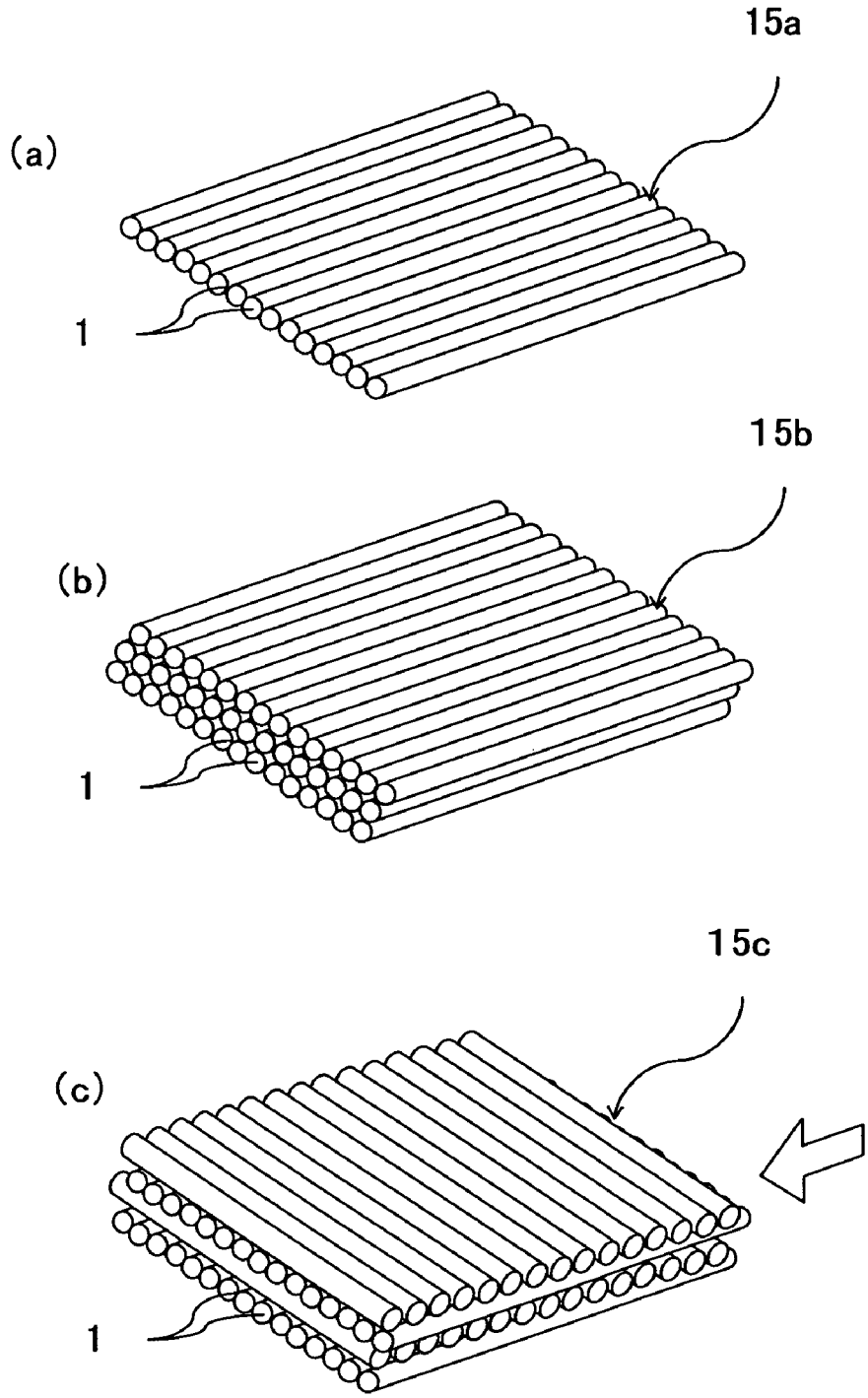
FIG. 4(*a*) through (*c*) are schematic perspective views showing further another embodiment of the present invention.

The composite structure of the present invention may have such configurations as, in addition to the multiple filament type composite structure, sheet-like structure 15*a* made by disposing the composite structures 1 in a sheet-like configuration as shown in FIG. 4(*a*), laminated structure 15*b* made by stacking a plurality of the sheet-like structures 15*a* in the same direction as shown in FIG. 4(*b*), or laminated structure 15*c* made by stacking a plurality of the sheet-like structures 15*a* in different directions as shown in FIG. 4(*c*)

Figure 5:
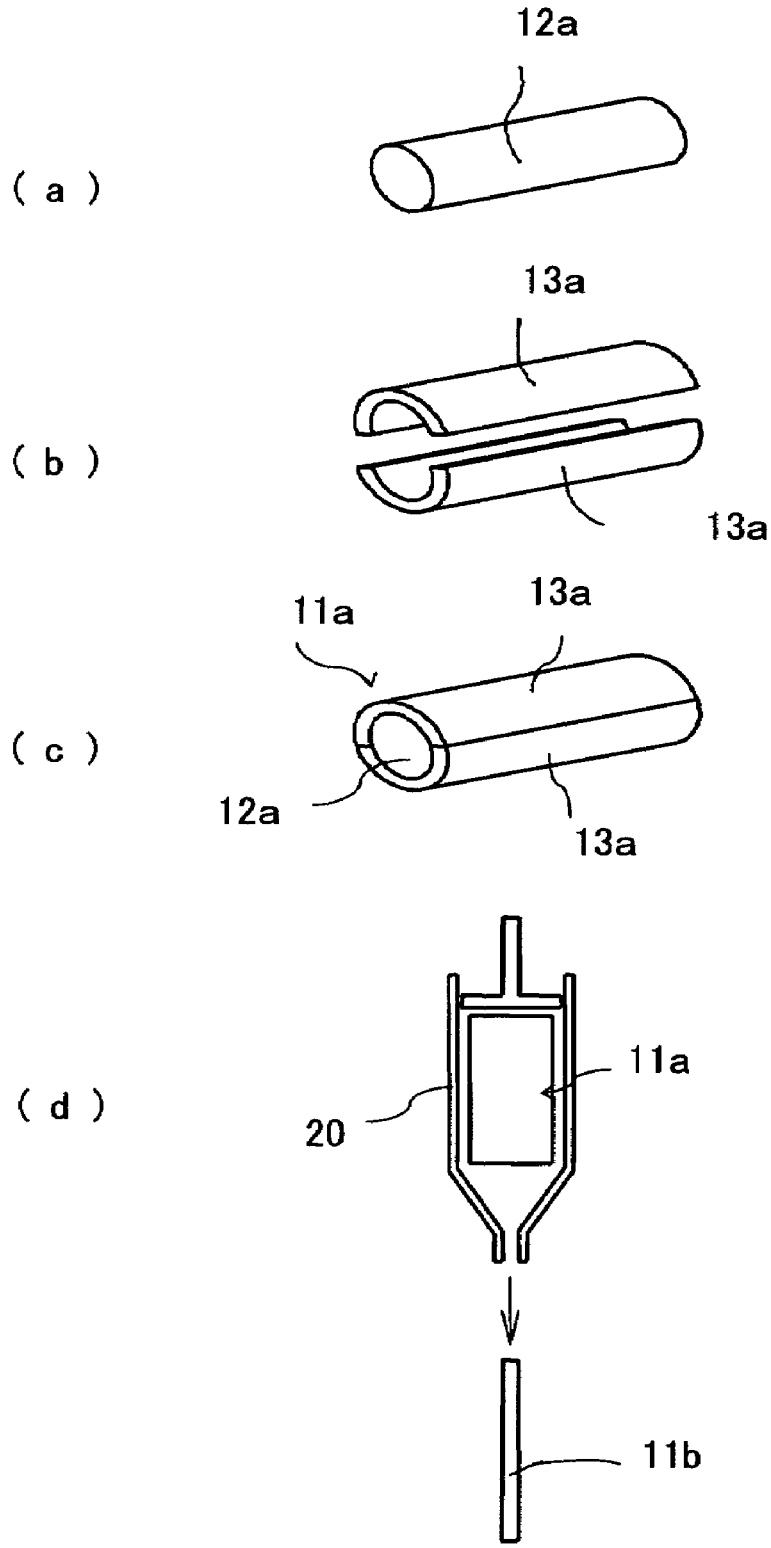
FIG. 5 is a schematic diagram explanatory of a method for manufacturing the composite structure of the present invention.

A method for manufacturing the composite structure 1 of the present invention will be described below, in such a case as an iron group metal is included as the binder in both materials used to make the core material and the shell layer, with reference to the schematic diagram of FIG. 5.

First, 50 to 98% by weight of diamond powder having a mean particle size in a range from 0.01 to 3.5 μm and 2 to 50% by weight of an iron group metal powder having a mean particle size of 10 μm or smaller are mixed. With an organic binder such as paraffin wax, polystyrene, polyethylene, ethylene-ethyl acrylate, ethylene-vinyl acetate, polybutyl methacrylate, polyethylene glycol, dibutyl phthalate or the like being added, the mixture is kneaded and molded into a cylindrical shape 12*a* in a molding process such as press molding, extrusion molding or casting (refer to process (a)).

In the meantime, 70 to 95% by weight of hard particles having a mean particle size in a range from 0.01 to 10 μm or a hard particle forming component, 1 to 20% by weight of diamond powder having a mean particle size in a range from 0.01 to 5 μm and 5 to 30% by weight of iron group metal powder having a mean particle size of 10 μm or smaller are mixed. With the binder described above being added, the mixture is kneaded and molded to make two green compacts for skin 13*a* having a shape of cylinder cut longitudinally into half in a molding process such as press molding, extrusion molding or casting (refer to process (b)). The green compacts for shell layer 13*a* are placed on the green compact for core material 12*a* so as to cover the circumference of the latter, thereby making a composite green compact 11*a* (refer to process (c)).

The composite green compact 11*a* is charged into an extrusion molding machine 20 so that the green compact for core material 12*a* and the green compact for shell layer 13*a* are extrusion molded at the same time (simultaneous extrusion molding), thereby making a composite green compact 11*b* that is extended with smaller diameter comprising the green compact for core material 12*a* covered by the green compact for shell layer 13*a* on the circumference thereof (refer to process (d)). The elongate green compact may be formed to have a cross section other than circle, such as triangle, rectangle or hexagonal, by using an extrusion die of corresponding shape.

As described previously, the elongate green compacts 11*b* may be disposed side by side to form a sheet, and the sheets may be stacked one on another into a laminate 15 with the composite green compacts of different sheets being arranged in parallel to each other or cross at any angle including 90° or 45° (refer to FIG. 4). The green compact may also be formed in any desired shape by a known molding process such as rapid prototyping process. Moreover, the sheets disposed as described above or composite structure sheet made by slicing the sheet in the direction of section may be stuck or bonded onto the surface of a sintered hard alloy (block) such as conventional cemented carbide.

Figure 6:
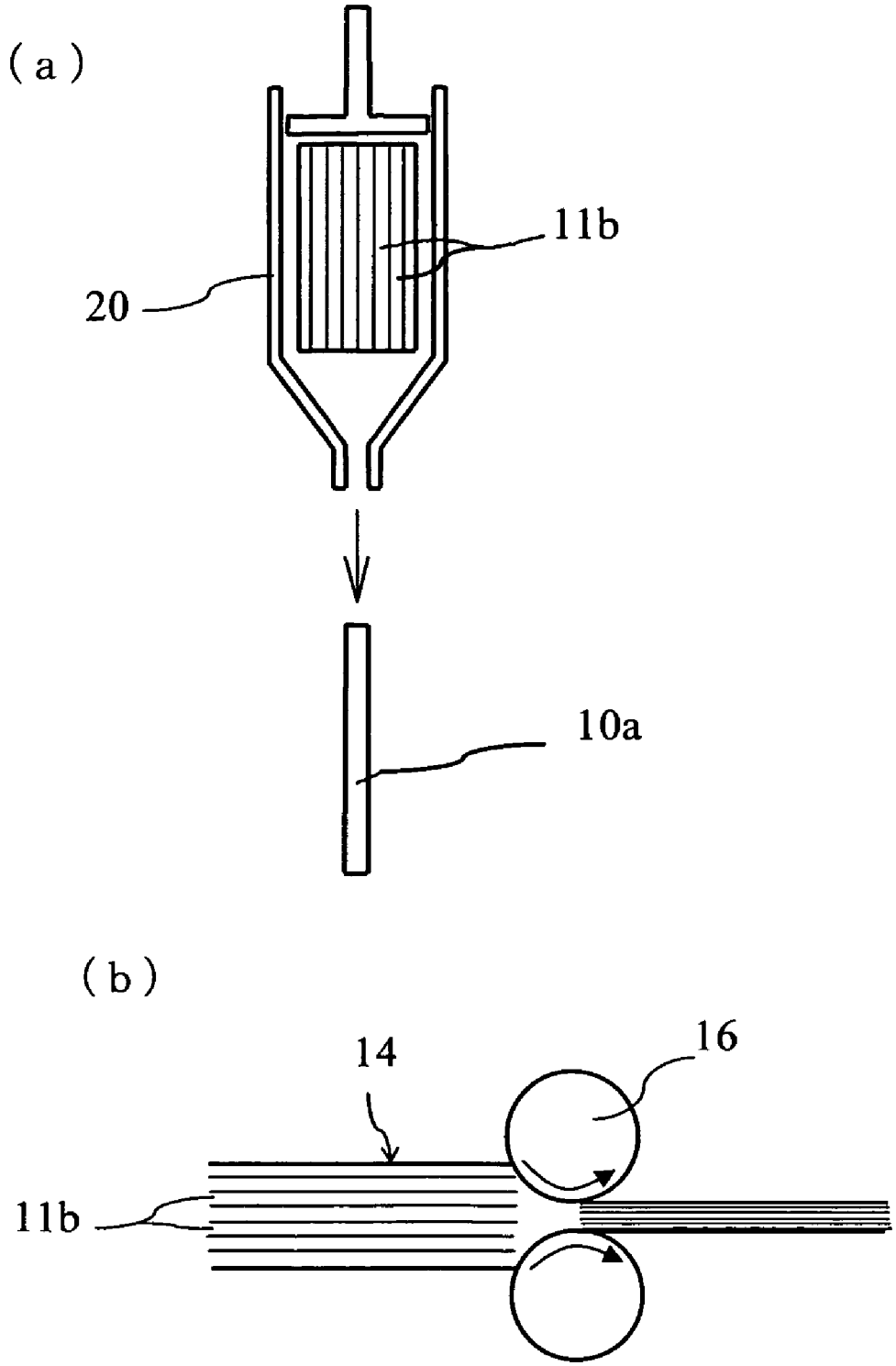
FIG. 6 is a schematic diagram explanatory of another method for manufacturing the composite structure of the present invention.

When the composite structures 1 are bundled into the composite structures 10, 15*a* to 15*c* of sheet shape as shown in FIG. 3, 4, the composite green compacts 11*b* made as described above are bundled to form a combined green compact. In this case, a bonding material such as the binder described above may be provided between the composite green compacts 11*b* with a pressure applied to the bundled green compact by means of cold isostatic pressing (CIP) or the like. The green compact 10*a* of multiple filament type may be manufactured by bundling a plurality of the elongate composite green compacts 11*b* that have been molded by simultaneous extrusion and charging it again into the extrusion molding machine 20 so as to carry out simultaneous extrusion molding again, as shown in FIG. 6(*a*). The bundled green compact 14 may also be rolled using a roll 16 as shown in FIG. 6(*b*).

The green compacts made by the methods described above are processed to remove the binder and sintered so as to make the composite structure of the present invention. While the sintering process varies depending on the kind of material of the core material and the shell layer, sintering in vacuum, sintering under gas pressure, hot pressing, discharge plasma sintering, ultra-high pressure sintering or the like may be employed. According to the present invention, in order to control the contents of the iron group metals 3, 7 in the core material 4 and in the shell layer 8 within predetermined ranges, it is preferable to sinter under a pressure of 4 GPa or higher, at a temperature of 1300° C. or higher for a period of 5 minutes to one hour, by using an ultra-high pressure apparatus.

In this process, sintering the composite structure 1 at a high temperature of 1400° C. or higher makes it possible to improve the balance between the wettability of the iron group metal with the core material 4 and the shell layer 8 and the surface tension so as to improve the concentration of iron group metal in the core material 4, thereby to distribute the iron group metals 3, 7 uniformly throughout the structure.

Figure 8:
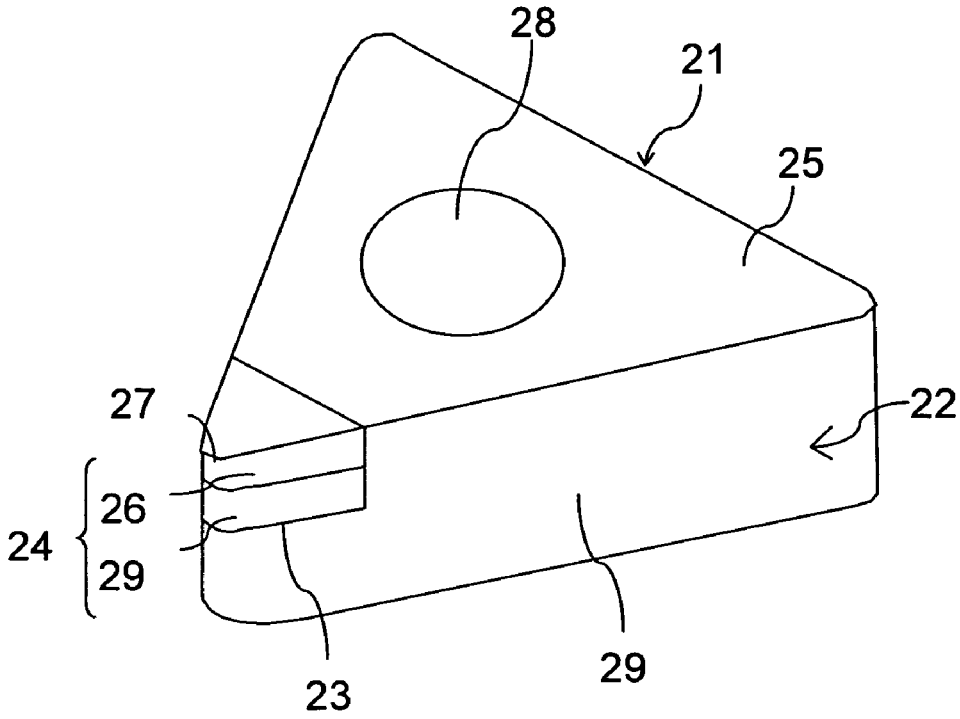
FIG. 8 is a perspective view showing an example of cutting tool.
Figure 9:
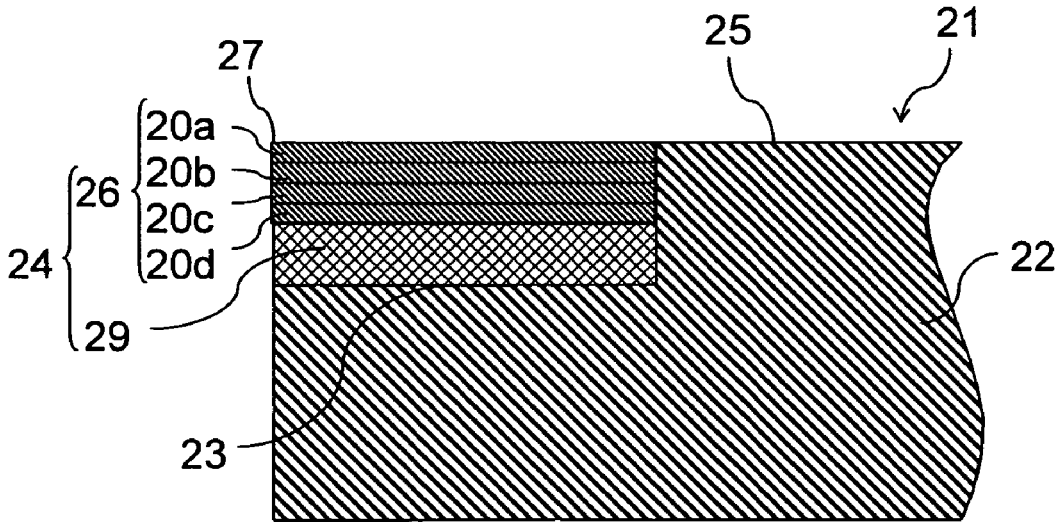
FIG. 9 is a sectional view of the cutting tool of FIG. 8 near cutting edge chip thereof.

Next a cutting tool that uses the composite structure of the present invention will be described with reference to FIG. 8 through FIG. 12. FIG. 8 is a schematic perspective view showing an example of the cutting tool, and FIG. 9 is a partially cutaway drawing of the cutting tool of FIG. 1. The cutting tool 21 shown in FIG. 8 has a shape of flat plate. A cutting-edge tip 24 constituted from a back plate 29 and a laminated composite structure 26 integrally bonded is brazed onto a mounting seat 23 formed at a corner of the tool 22.

The cutting tool 21 has a cutting edge 27 formed at the intersect between a rake surface 25 and a side relief surface 29.

The cutting tool 21 has also, at the center thereof, a set hole 28 through which a clamp screw or the like passes for mounting on a tool.

The laminated composite structure 26 is formed by bundling the single filament type composite structures (filaments) constituted from the core material 4 and the shell layer 8 (coating layer) that is made of a material having different composition from that of the core material 4 and covers the circumference of the core material 4 as shown in FIG. 1, or multiple filament type composite structure 10 (filaments) formed by extending the bundled single filament type composite structure as shown in FIG. 3. It is preferable to use the multiple filament type composite structure 10 as shown in FIG. 3 because it improves chipping resistance.

According to the cutting tool 21 described above, it is important to dispose the composite structures so that the direction of filament orientation in the plurality of composite structures 1, 10 arranged in parallel (namely the longitudinal direction) or the direction of the interface between the core material 4 and the shell layer 8 of the composite structure 1 is not directed parallel to the direction of the cutting edge 17.

Figure 11:
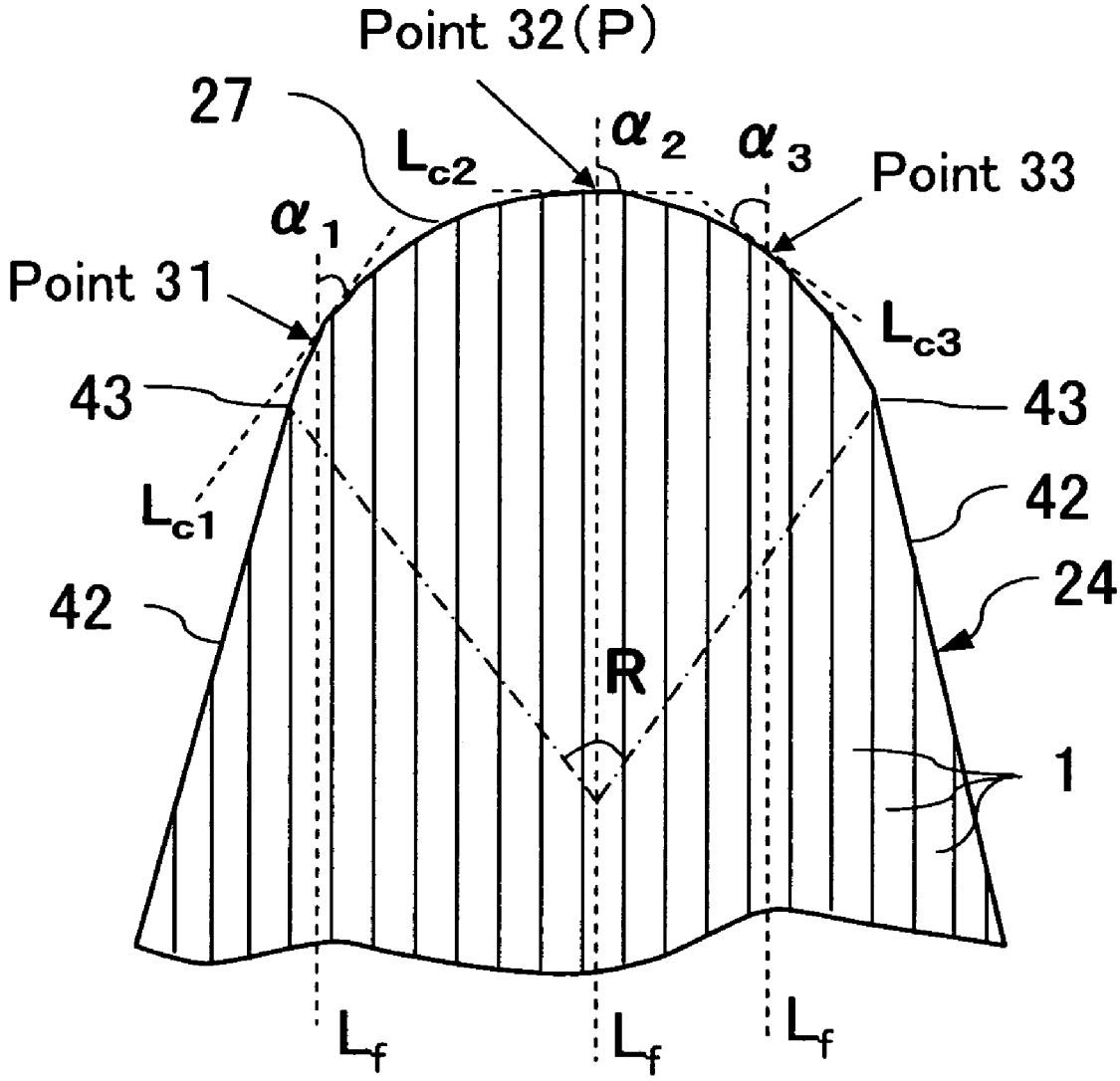
FIG. 11 is a plan view of the cutting edge chip of FIG. 8 viewed on the rake surface thereof.

That is, as shown in the plan view of the cutting edge chip of FIG. 11, angle $\alpha$ between the filament direction $L_f$ of the composite structures 1, 1, . . . and tangential direction $L_C$ in the ridgeline of the cutting edge 27 is 2° or larger, preferably 5° or larger and more preferably 10° or larger at any position of the cutting edge. Specifically, it is important that angle $\alpha_1$ at point 31, angle $\alpha_2$ at point 32 and angle $\alpha_3$ at point 33 on the cutting edge 27 all fall in the above range.

The angle $\alpha_2$ of the tangential direction $L_{C2}$ at point 32 (P) that is the apex of the nose R of the cutting edge 27, in particular, is preferably 45° or larger, more preferably 70° or larger and more preferably 85° or larger.

As a result, largest stress generated during cutting is directed in a direction different from the direction of boundary between the filaments of the composite structures 1, namely the direction of filament, or the direction of the interface between the core material 4 and the shell layer 8 of the composite structure 1, namely the direction of filament orientation, so that the stress generated by cutting operation can be prevented from concentrating in the interface between the core material 4 and the shell layer 8, and the stress can be distributed in the longitudinal direction of the composite structure 1 in which toughness is higher. As a result, chipping resistance of the cutting tool is improved over the entire cutting edge 27.

When the angle $\alpha$ is smaller than the range described above, such a tensile stress is generated by cutting that causes peel-off in the interface between the core material 4 and the shell layer 8 of the composite structure 1, thus increasing the possibility of chipping to occur due to peel-off in the interface located on the cutting edge 17 during cutting operation.

The angle $\alpha$ is controlled by adjusting the direction of disposing the composite structure 1 with respect to the cutting tool shape and the region of forming the cutting edge 17, namely the shape of the cutting tool such as shape and angle of the nose R. This is applicable to tool inserts having T, D or V-type shape that has rake surface of rhombic configuration where the angle R of the nose R is less than 90°, particularly 80° or less and more particularly 60° or less. In FIG. 11, nose R means the cutting edge that extends from the apex (P) to both sides to a joint 43 that is the boundary with a straight portion 42.

In FIG. 11, the angle $\alpha$ between the filament direction $L_f$ of the composite structures 1 and tangential direction $L_{C2}$ of the nose R at the apex P is 2°, namely the filament direction $L_f$ of the composite structures 1 extends perpendicularly toward the apex P of the nose R.

Figure 12:
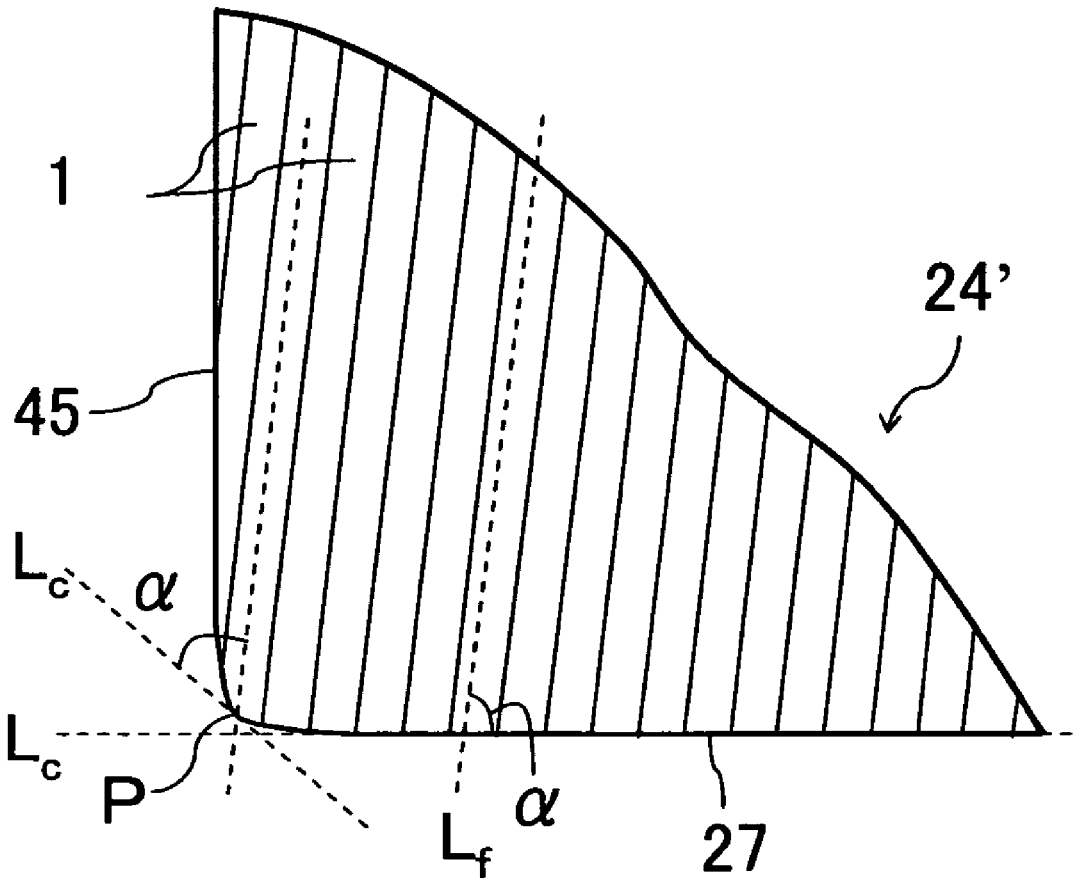
FIG. 12 is a schematic diagram showing another example of cutting tool viewed on the rake surface thereof.

In an indexable insert type cutting tool of the so-called S-type where the angle R of the nose R is 90° and the rake surface 25 has square shape, only one side of the nose R is used as the cutting edge 12 as shown in FIG. 12, while the opposite side 45 is not used as the cutting edge, namely the cutting tool is limited to left-hand wise or right-hand wise. In such an indexable insert type cutting tool, the angle $\alpha$ between the filament direction $L_f$ of the composite structures 1 and the tangential direction $L_{C2}$ of the nose R at the apex P may be 45° or less as long as the angle $\alpha$ between the filament direction $L_f$ of the composite structures 1 and the tangential direction $L_{C1}$ at the cutting position 2° or larger.

Figure 10:
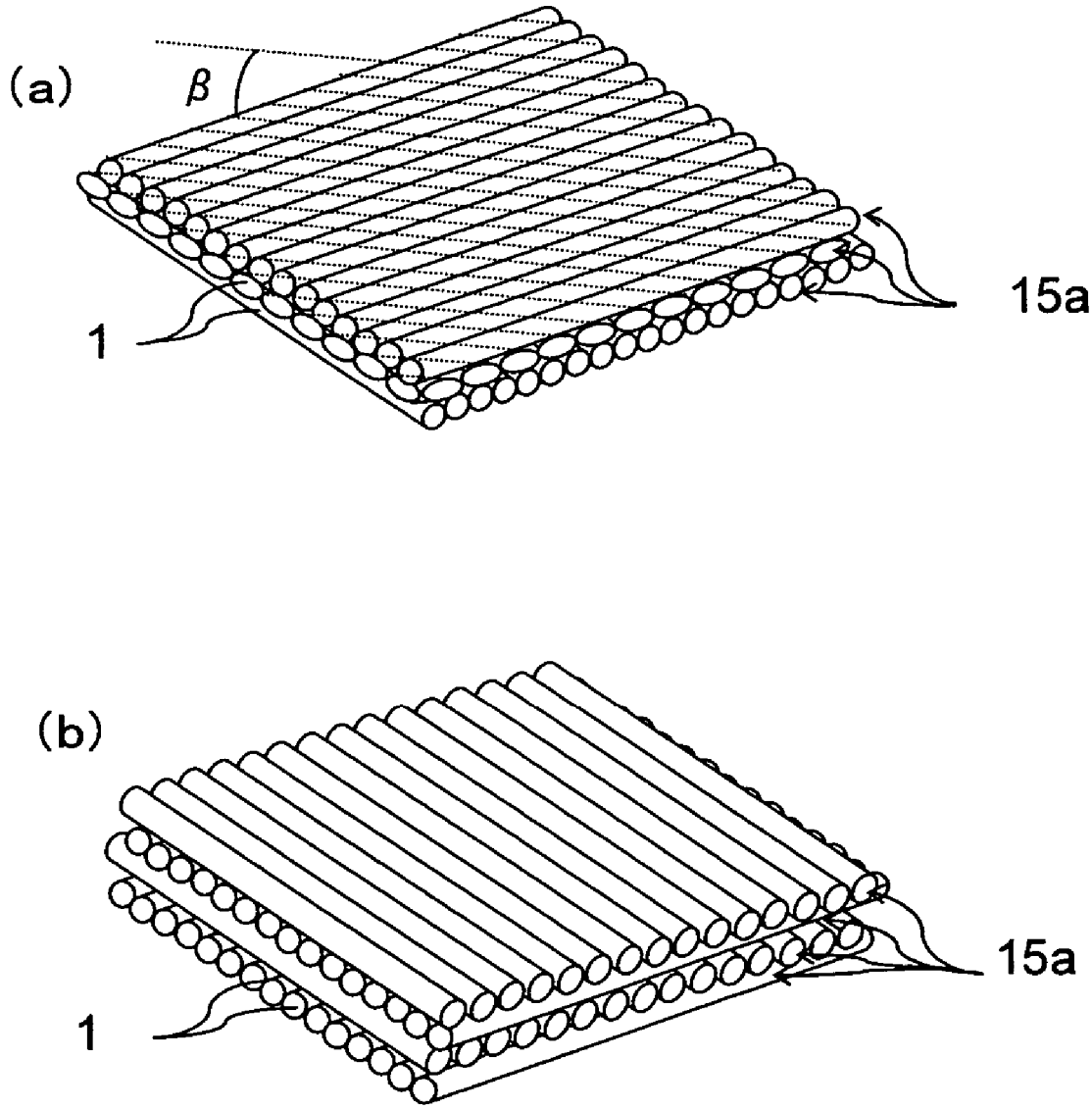
FIG. 10(*a*), (*b*) are schematic perspective view explanatory of the constitutions of the composite structures.

As shown in FIG. 9 and FIG. 10, the laminated composite structure 26 is made by stacking a plurality of composite layers 20*a* through 20*d* that are formed by arranging a plurality of composite structures 1, 10 in one direction, one on another in the direction of thickness. When manufacturing the composite structure 26, it is preferable that the composite structure sheets 34 are stacked so as to be directed in different directions between the layers, which makes it possible to further improve the toughness of the laminated composite structure 26 and improve the chipping resistance of the cutting tool further.

The angle $\beta$ that represents the deviation between the directions of the composite structures 1, 10 between adjacent layers is in a range from 5 to 90°, and preferably from 25 to 60°. FIG. 10(*a*) shows an example of stacking with $\beta$ of 45°, and FIG. 10(*b*) shows an example of stacking with $\beta$ of 90°.

The cutting tool may be of solid type, but is preferably an indexable insert type cutting tool for the reason of lower cost and ease of manufacture. It is made easier to control the direction of filament orientation in the composite structures 1 with respect to the cutting edge shape of the tool, and makes it easier to arrange the composite structure 1 when forming cutting edges on a plurality of corners, by forming a recess at the cutting edge position of the cutting tool 22, setting a cutting edge chip 14 that has the composite structure 26 on the mounting seat 13 and securing it by brazing or the like.

The size of the composite structure 1 is preferably from 5 to 300 μm in diameter of the core material 4, and from 6 to 500 μm in diameter of one composite structure 1 including the shell layer 8, in order to improve the chipping resistance of the cutting tool.

To manufacture the cutting tool 21, the laminated composite structure 26 is machined by wire discharge machining, cutting, polishing or the like so that the angle $\alpha$ becomes the predetermined value for the relation with the cutting edge 27 of the cutting tool as described previously. Then the back plate 29 made of a hard sintered material such as cemented carbide is attached on the bottom of the composite structure 26, thereby making the cutting edge chip 24. The back plate 29 is preferably integrally sintered together with the composite structure 26 when sintering the laminate described above.

The cutting edge chip 24 thus made is brazed onto the mounting seat 23. The composite structure 26 may also be brazed directly onto the cutting tool 22 without attaching the back plate 29.

When making the composite structure 26, the composite structure sheets 34 may also be stacked in the same direction between the adjacent layers.

Examples of the present invention will be described below. It is understood, however, that the examples are for the purpose of illustration and the invention is not to be regarded as limited to any of the specific materials or condition therein.

EXAMPLE I

Cobalt powder having a mean particle size of 2 μm was added in proportion shown in Table 1 to diamond powder having a mean particle size shown in Table 1. After adding a binder and a lubricant agent and kneading, the mixture was press-formed to make green compact for core material measuring 18 mm in diameter.

Diamond powder and cobalt powder having a mean particle size of 2 μm were added in proportions shown in Table 1 to hard particle (WC) powder having a mean particle size shown in Table 1. After adding a binder and a lubricant agent and kneading, the mixture was press-formed to make two green compacts for shell layer having a wall thickness of 1 mm and a shape of cylinder cut longitudinally into half by press molding. These green compacts were placed on the green compact for core material to cover the circumference thereof thereby making a composite green compact.

After forming the elongated green compact by extrusion molding of the composite green compact, 100 pieces of the elongated green compact were bundled and molded again by extrusion, thus making the multiple filament type composite structure. Then after processing to remove the binder, the green compact was set in an ultra-high pressure apparatus and was sintered at the temperature shown in Table 1 under a pressure of 5 GPa thereby making the composite structure.

Vickers hardness (according to JIS R1601) of the composite structure thus obtained was measured. Mean diameter $D_1$ of the core material and mean thickness $D_2$ of the shell layer were calculated by image analysis using a scanning electron microphotograph of the polished cross section of the sample. Wavelength dispersive X-ray spectroscopy microanalysis (EPMA) was conducted at five points of the structure, to measure the concentration of iron group metal over the region ranging from the center of the core material to the interface with the shell layer, and calculate the width "w" of the region having a low concentration of iron group metal. EPMA was conducted under the conditions of acceleration voltage of 15 kV, probe current of $3\times10^{-7}$ A and spot size of 2 μm.

A green compact was made by stacking a plurality of sheet-like green compacts as indicated by reference numeral 15*c* in FIG. 4(*c*), and the green compact was sliced in the direction of cross section to make sheets 3 mm in thickness (slicing direction is indicated by an arrow in FIG. 4(*c*)). This sheet and cemented carbide were laminated and sintered under the ultra-high pressure under conditions similar to those described above. The sample thus obtained was cut into a square of 10 mm×10 mm with a wire discharge machine to make an indexable inserts having TPGN 160304 shape. The cutting tips were subjected to cutting test under the following cutting conditions (10 test pieces for each test), to determine the mean wear width, adhesion condition and the number of pieces that experienced chipping. The results are shown in Table 2.

The cutting conditions are as follows.

Infeed d=2 mm, Cutting speed V=200 m/min., Feed rate f=0.2 mm/rev., Workpiece material ADC12 (with four grooves)

TABLE 1

| | Core Material (Mixing Composion) | | | Shell Layer (Mixing Composion) | | | | | | |
|---|---|---|---|---|---|---|---|---|---|---|
| | Diamond | | | WC | | Diamond | | | | |
| | Particle | | Co | Particle | | Particle | | Co | Sintering | |
| Sample No. | size (μm) | Content (wt %) | Content (wt %) | size (μm) | Content (wt %) | size (μm) | Content (wt %) | Content (wt %) | Temp. (° C.) | Time (min.) |
| I-1 | 3 | 90 | 10 | 3 | 80 | 3 | 10 | 10 | 1400 | 15 |
| I-2 | 2 | 90 | 10 | 2 | 90 | 2 | 5 | 5 | 1400 | 15 |
| I-3 | 0.5 | 80 | 20 | 0.5 | 85 | 0.5 | 10 | 5 | 1450 | 15 |
| I-4 | 0.5 | 90 | 10 | 5 | 81 | 2 | 15 | 4 | 1500 | 15 |
| *I-5 | 3 | 85 | 15 | 3 | 85 | 10 | 5 | 10 | 1500 | 30 |
| *I-6 | 0.5 | 80 | 20 | 2 | 92 | — | | 8 | 1400 | 15 |
| *I-7 | 2 | 90 | 10 | 2 | 95 | — | | 5 | 1400 | 15 |
| *I-8 | 2 | 70 | 30 | 10 | 67 | 2 | 12 | 21 | 1450 | 15 |
| *I-9 | 2 | 85 | 15 | 2 | 96 | 2 | 1 | 3 | 1400 | 15 |
| *I-10 | 2 | 85 | 15 | 5 | 39 | 2 | 21 | 40 | 1400 | 15 |

Sample numbers marked with * are not within the scope of the present invention.

TABLE 2

| | Core Material (Diamond Sintered Body) | | | Shell Layer (Cemented Carbide) | | | | | | | | | Cutting Performance | | |
|---|---|---|---|---|---|---|---|---|---|---|---|---|---|---|---|
| | Diamond | | Co | WC | | Diamond | | Co | | | | | | | |
| Sample No. | Particle size (μm) | Content (vol %) | Content (vol %) | Particle size (μm) | Content (vol %) | Particle size (μm) | Content (vol %) | Content (vol %) | $w/D_1$ | $d_{S1}/d_{S2}$ | $D_2/D_1$ | Hardness (GPa) | Wear Width (mm) | Adhe-sion | Chip-ping |
| I-1 | 3 | 89 | 11 | 3 | 60 | 3 | 35 | 5 | 0.03 | 1 | 0.05 | 53 | 0.048 | None | 0/10 |
| 1-2 | 2 | 93 | 7 | 2 | 77 | 2 | 19 | 4 | 0.05 | 1 | 0.05 | 55 | 0.046 | None | 0/10 |
| I-3 | 0.5 | 90 | 10 | 0.5 | 63 | 0.5 | 32 | 5 | 0.12 | 1 | 0.1 | 54 | 0.050 | None | 0/10 |
| I-4 | 0.5 | 94 | 6 | 5 | 52 | 2 | 45 | 3 | 0.15 | 0.4 | 0.08 | 62 | 0.053 | None | 0/10 |
| *I-5 | 3 | 87 | 13 | 3 | 74 | 10 | 19 | 7 | 0.22 | 0.3 | 0.06 | 53 | 0.085 | Few | 2/10 |
| *I-6 | 0.5 | 83 | 17 | 2 | 90 | — | | 10 | 0.32 | — | 0.1 | Peeling | 0.080 | Many | 6/10 |
| *I-7 | 2 | 91 | 9 | 2 | 96 | — | | 4 | 0.25 | — | 0.06 | 48 | 0.125 | Few | 5/10 |
| *I-8 | 2 | 78 | 22 | 10 | 50 | 2 | 40 | 10 | 0.23 | — | 0.07 | 40 | 0.183 | Many | 3/10 |
| *I-9 | 2 | 93 | 7 | 2 | 92 | 2 | 4 | 4 | 0.30 | 1 | 0.05 | 49 | 0.090 | None | 5/10 |
| *I-10 | 2 | 80 | 20 | 5 | 25 | 2 | 60 | 15 | 0.05 | 0.4 | 0.1 | 42 | 0.152 | Many | 2/10 |

Sample numbers marked with * are not within the scope of the present invention.

The results shown in Tables 1 and 2 indicate that the cutting tools having the composite structure of the samples Nos. I-1 through I-4 maintain high hardness of 50 GPa or higher, with high wear resistance and high adhesion resistance with regard to the cutting performance, and are less likely to experience chipping.

The sample No. I-5 in which the mean particle size of the diamond particles included in the shell layer is larger than 5 μm, in contrast, show large variations in wear resistance and chipping resistance. The samples Nos. I-6 through I-8 in which the shell layer does not include diamond particles are inferior in either hardness, wear, adhesion or variation in chipping. The sample No. I-9 in which content of diamond particles in the shell layer is less than 5% by volume show large variations in wear resistance and chipping resistance. The sample No. 10 in which the content of diamond particles in the shell layer is more than 45% by volume is inferior in either wear, adhesion or variation in chipping.

EXAMPLE II

The multiple filament type composite structure of the sample No. I-2 obtained in Example I was cut into length of 100 mm, and arranged in parallel into sheet. Three composite sheets were stacked with the direction of filament orientation aligned in the same direction, thereby making a laminate.

Then a back plate made of sintered cemented carbide 5 mm in thickness was attached on the bottom of the laminate, and binder-removing treatment was conducted by heating at the temperature from 300 to 700° C. for 100 hours. Then the laminate was set in an ultra-high pressure apparatus and was sintered at 1450° C. for 15 minutes, thereby making cutting edge chip constituted from the composite structure and the back plate that are integrated together. Then the cutting edge chip was machined and brazed onto the mounting seat of the tool body made of cemented carbide at 700° C.

Minimum value of the angle α between the filament direction $L_f$ of the composite structures 1 that constitutes the sheet and the tangential direction $L_C$ of the cutting edge of the cutting edge chip, αmin, is shown in Table 3. An angle αp between the filament direction $L_f$ of the composite structures 1 at the apex P of the nose R and tangential direction $L_C$ at the apex P is shown in Table 3.

Cutting tools made as described above were used to cut a plurality of workpieces (ADC12, with four grooves) under the following conditions, and determined the number of workpieces (2500 pieces maximum) before breaking or chipping occurred. The results are shown in Table 3.

Infeed d=1 mm

Cutting speed V=100 m/min.

Feed rate f=0.1 mm/rev.

TABLE 3

| Sample No. | Tip Top Angle(°) | α min (°) | α p (°) | Number of Workpieces Before Breaking or Chipping Occurred |
|---|---|---|---|---|
| II-1 | 55 | 25 | 90 | >2500 |
| II-2 | 60 | 30 | 90 | >2500 |
| II-3 | 80 | 40 | 90 | >2500 |
| II-4 | 90 | 45 | 90 | >2500 |
| II-5 | 60 | 20 | 80 | >2500 |
| II-6 | 60 | 10 | 70 | >2500 |
| II-7 | 60 | 5 | 65 | Chipping at 1800 |
| II-8 | 60 | 2 | 62 | Chipping at 1000 |
| II-9 | 60 | 0 | 60 | Breaking at 100 |
| II-10 | 60 | 0 | 0 | Breaking at 50 |
| II-11 | 90 | 5 | 50 | >2500 |
| II-12 | 90 | 5 | 45 | Chipping at 2000 |
| II-13 | 90 | 5 | 40 | Chipping at 1200 |

As will be clear from Table 3, the samples Nos. II-1 through II-8 and II-11 through II-13 in which the angle α is 2° or larger show larger number of workpieces machined before chipping and higher chipping resistance than samples Nos.II-9 and 10 in which the angle α is less than 2°.

EXAMPLE III

Cutting tools were made similarly to Example II except for making the laminate by stacking three composite sheets so that relation between the directions of filaments (angle β in FIG. 10(*a*)) between the adjacent composite sheets become as shown in Table 4. Tip angle (nose R), minimum angle (αmin) and angle (αp) of each cutting tool are shown in Table 4. In Table 4, the samples Nos. III-15, III-16 and III-1 7 were made in such a constitution as only the portion to the right of the apex P of the nose R was used as the cutting edge, namely right-hand wise cutting edge. The samples were subjected to cutting operation similarly to Example II, and the number of workpieces (2500 pieces maximum) was determined. The results are shown in Table 4.

TABLE 4

| Sample No. | Tip Top Angle (°) | α min (°) | α p (°) | Angle β of Directions of Filaments Between Adjacent Composite Sheets (°) | Number of Workpieces Before Breaking or Chipping Occurred |
|---|---|---|---|---|---|
| III-1 | 55 | 25 | 90 | 15 | >2500 |
| III-2 | 60 | 30 | 90 | 30 | >2500 |
| III-3 | 80 | 40 | 90 | 40 | >2500 |
| III-4 | 90 | 45 | 90 | 45 | >2500 |
| III-5 | 60 | 20 | 80 | 10 | >2500 |
| III-6 | 60 | 10 | 70 | 30 | >2500 |
| III-7 | 60 | 10 | 70 | 2 | Chipping at 1800 |
| III-8 | 60 | 2 | 62 | 0 | Chipping at 1000 |
| III-9 | 60 | 2 | 62 | 5 | Chipping at 1800 |
| III-10 | 60 | 2 | 62 | 25 | >2500 |
| III-11 | 60 | 2 | 62 | 45 | >2500 |
| III-12 | 60 | 2 | 62 | 70 | Chipping at 2000 |
| III-13 | 60 | 0 | 60 | 20 | Breaking at 100 |
| III-14 | 60 | 0 | 0 | 0 | Breaking at 50 |
| III-15 | 90 | 5 | 50 | 60 | >2500 |
| III-16 | 90 | 5 | 45 | 45 | >2500 |
| III-17 | 90 | 5 | 40 | 80 | Chipping at 1600 |

As will be clear from Table 4, the samples Nos. III-1 through III-7 and III-9 through III-12 and III-15 through III-17 where the angle α is 2° or larger show larger number of workpieces machined before chipping and higher chipping resistance than samples Nos. III-13 and III-14 where the angle α is less than 2°. Chipping resistance could be improved by changing the direction of filament orientation, namely setting the angle β>0, compared to the sample No. III-8 where the angle between directions of filaments in adjacent composite layers is 0°.

What is claimed is:

1. A composite structure comprising:

an elongate core material of a sintered diamond comprising 80% by volume or more diamond particles of a mean particle size not larger than 3.5 μm, and an iron group metal binding the diamond particles; and a shell layer that covers the circumference of said core material and comprises a sintered alloy of at least one kind of hard particles selected from among carbide, nitride and carbonitride of at least one metal element selected from the group of 4a, 5a and 6a group metals of the Periodic Table, and diamond particles of a mean particle size not larger than 5 μm, and an iron group metal binding the hard particles and diamond particles, wherein content of said diamond particles included in said shell layer is from 5 to 45% by volume.

2. The composite structure according to claim 1, wherein a ratio $w/D_1$ of a width "w" of a region having a low concentration of iron group metal in said core material in said interface with said shell layer to the mean diameter "$D_1$" of said core material is 0.2 or less.

3. The composite structure according to claim 1, wherein a ratio $d_{S1}/d_{S2}$ of the mean particle size $d_{S1}$ of the diamond particles in said shell layer to the mean particle size $d_{S2}$ of the hard particles included in said shell layer is in a range from 0.4 to 3.0.

4. The composite structure according to claim 1, wherein a ratio $D_2/D_1$ of the mean thickness $D_2$ of said shell layer to the mean diameter $D_1$ of said core material is in a range from 0.01 to 0.5.

5. A multiple filament type composite structure comprising a plurality of composite structures of claim 1, which are bundled and bonded.

6. A sheet-like composite structure comprising a plurality of composite structures of claim 1, which are arranged and bonded in a sheet-like configuration.

7. A laminated composite structure comprising a plurality of sheet-like composite structures of claim 6, which are stacked.

8. The laminated composite structure according to claim 7 wherein the sheet-like composite structures are alternately stacked in different directions.

9. The composite structure according to claim 1 or 6 that is used as a cutting tool.

* * * * *